US008964348B2

(12) United States Patent
Pantke

(10) Patent No.: US 8,964,348 B2
(45) Date of Patent: Feb. 24, 2015

(54) ACTUATOR DEVICE AND DRIVING METHOD

(75) Inventor: Michael Pantke, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 211 days.

(21) Appl. No.: 13/824,658

(22) PCT Filed: Aug. 3, 2011

(86) PCT No.: PCT/EP2011/063341
§ 371 (c)(1),
(2), (4) Date: Mar. 18, 2013

(87) PCT Pub. No.: WO2012/038135
PCT Pub. Date: Mar. 29, 2012

(65) Prior Publication Data
US 2013/0201590 A1 Aug. 8, 2013

(30) Foreign Application Priority Data
Sep. 21, 2010 (DE) ..... 10 2010 041 086

(51) Int. Cl.
*H01H 47/00* (2006.01)
*H01F 7/06* (2006.01)
*H01F 7/16* (2006.01)
*H01F 7/18* (2006.01)

(52) U.S. Cl.
CPC ..... *H01F 7/064* (2013.01); *H01F 7/1615* (2013.01); *H01F 7/1872* (2013.01); *H01F 2007/1692* (2013.01)
USPC ..... 361/152

(58) Field of Classification Search
USPC ..... 361/152
See application file for complete search history.

(56) References Cited

U.S. PATENT DOCUMENTS

| | | | | |
|---|---|---|---|---|
| 3,894,442 | A * | 7/1975 | Hembree | 74/335 |
| 4,422,060 | A * | 12/1983 | Matsumoto et al. | 335/256 |
| 4,796,853 | A * | 1/1989 | Butts et al. | 251/129.05 |
| 6,626,146 | B1 | 9/2003 | Yanai et al. | |
| 6,646,851 | B1 * | 11/2003 | Gudat | 361/160 |
| 7,804,674 | B2 | 9/2010 | Keller et al. | |
| 7,898,121 | B2 * | 3/2011 | Ramsay et al. | 310/14 |
| 8,228,149 | B2 * | 7/2012 | Puth et al. | 335/229 |
| 2005/0279299 | A1 | 12/2005 | Degner et al. | |
| 2006/0049701 | A1 | 3/2006 | Sato | |

FOREIGN PATENT DOCUMENTS

| | | | |
|---|---|---|---|
| DE | 10 2005 018 012 | A1 | 10/2006 |
| DE | 10 2008 043 288 | A1 | 5/2010 |
| EP | 1 106 808 | A2 | 6/2001 |
| WO | 20081119786 | A1 | 10/2008 |
| WO | 20091109444 | A1 | 9/2009 |
| WO | 20101049234 | A1 | 5/2010 |

* cited by examiner

*Primary Examiner* — Stephen W Jackson
(74) *Attorney, Agent, or Firm* — Davis & Bujold, PLLC; Michael J. Bujold

(57) ABSTRACT

An actuator device (6) with an electromagnetic actuator (3) which has first and second magnet coils (4, 5) and a shift element (3) which can be linearly shifted, between three stable positions, by the first and the second magnet coils (4, 5). The actuator device (6) has a shifting bridge (9), with three bridge branches (B1, B2, B3) connected in parallel, for controlling the magnet coils (4, 5). Each bridge branch (B1, B2, B3) has two switches (S1 . . . S6) connected in series. One of the first and the second magnet coils (4, 5) is connected in each of the two bridge diagonals (D1, D2). In addition, a method for the control of the magnet coils (4, 5) of an electromagnetic actuator (2) of the actuator device (6).

14 Claims, 3 Drawing Sheets

Figure 3:
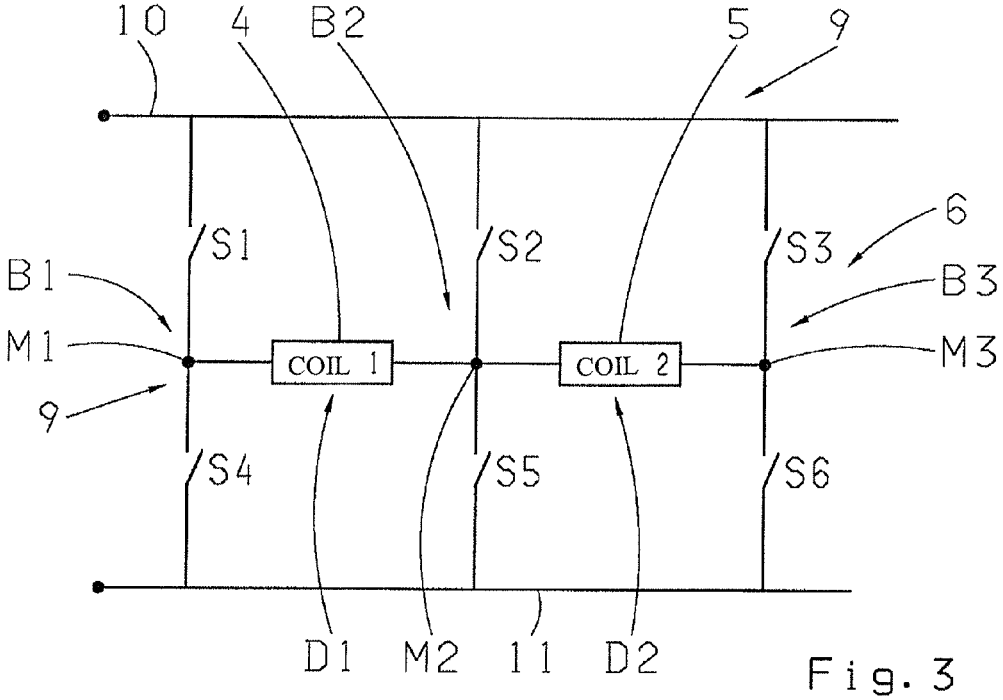

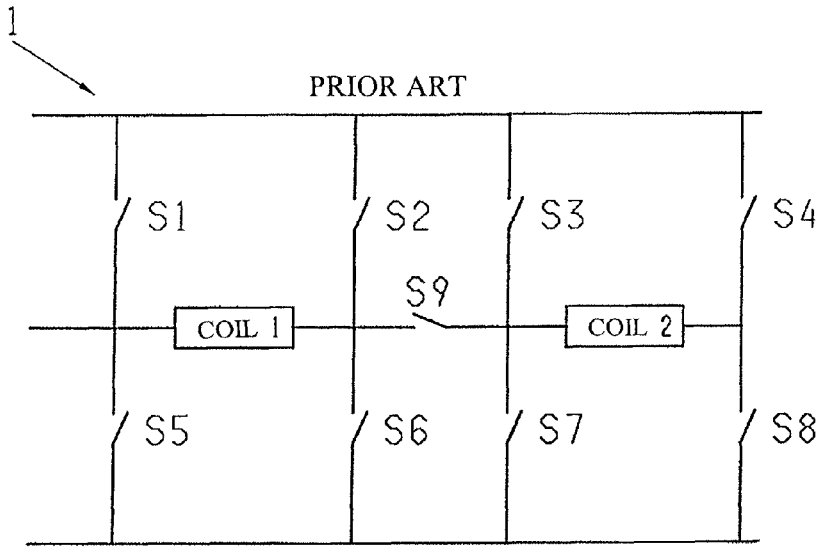
Fig. 1
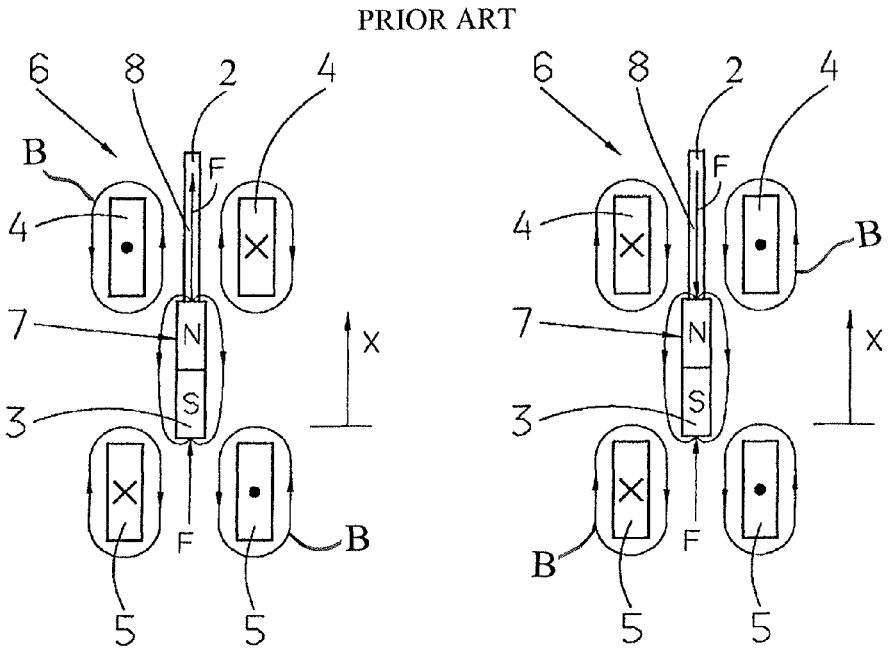
Fig. 2a
Fig. 2b

ACTUATOR DEVICE AND DRIVING METHOD

This application is a National Stage Completion of PCT/EP2011/063341 filed Aug. 3, 2011 which claims priority from German application serial no. 10 2010 041 086.1 filed Sep. 21, 2010.

FIELD OF THE INVENTION

The present invention concerns an actuator device and a method for the control.

BACKGROUND

Through the publication DE 10 2005 018 012 A1, an electromagnetic or electro-dynamic actuator, respectively, of the present art is known, whereby the position of the actuator shift element can be determined through a) an overlay—for this purpose—of the series positioned magnet coils with a voltage spike and b) a determination of the hereby resulting voltage patterns with just little effort.

Also, known from the publication WO 2009/109444 is an electromagnetic actuator of the same genus with three stabile positions or as triple-position actuator, respectively, which can be utilized for the execution of this present invention, and where its shift element position can be determined through the teaching of the initially mentioned publication.

For the control of electromagnetic, triple-position actuators where their actuator element position shall be determined, the state of the art currently utilizes two H-bridges, as well as a connecting switch (S9 in FIG. 1), to specifically adjust the currents in each single coil. The connecting switch serves to establish a series circuit to advantageously execute an inherent distance measurement or rather position of the termination, in accordance with the principle as presented in the publication DE 2005 018 012 A1.

SUMMARY OF THE INVENTION

Based on the above, the present invention has the task to further, advantageously develop the actuator devices of the above mentioned art, especially to enable hardware optimized control of the actuator which can be cost-effectively realized. Also, it is the task of the invention to propose a method for the control of the actuator which can be simply executed and which enables determination of the position of the actuator element in the initially mentioned manner.

An actuator device, in accordance with the invention, is proposed with an electromagnetic actuator which comprises two magnet coils as well as a shift element which can be linearly positioned between three stable positions, furthermore the actuator device, for the control of the magnet coils comprises of a shift bridge with three, in particular precisely three parallel connected bridge branches, whereby each bridge branch has two, in particular precisely two, serially positioned switches, wherein in each of the two bridge diagonals is connected a respective magnet coil, in particular precisely each one.

In an embodiment in accordance with the invention of the actuator device, the shift bridge is designed as a B6-Shift bridge.

In an additional embodiment in accordance with the invention of the actuator device, at least the switches of the first of the three bridge branches, which is electrically connected via a magnet coil in a first of the two bridge diagonals with a second of the three bridge branches, and the switches of a third of the three bridge branches which is connected via a magnet coil in the second of the two bridge diagonals also with the second bridge branch, are each equipped with a recovery diode.

In another additional embodiment of the invented actuator device, the actuator device is designed for the determination of the position of the actuator element.

In accordance with an aspect of the invented actuator device, the actuator device has for the determination of the position of the shift element, a control device which is designed to control the shift bridge in a way so that both magnet coils can be controlled in series between a common electrical input and a common electric output of the bridge branches and which, by means of a connectable supply voltage, a common electrical input and output of the bridge branches, can be overlaid with a voltage spike.

In accordance with an additional aspect of the inventive actuator device, the actuator device has a detection device for determining the position of the actuator element which is provided for the determination of the voltage pattern at both magnet coils during their overlay with a voltage spike.

In accordance with an additional aspect of the invented actuator device, the actuated device also has for the determination of the position of the actuator element, a processing device which, based on the determined voltage patterns of both magnet coils during a voltage spike, determines the position of the actuator element, in particular by comparison of at least one voltage curve with a characteristic diagram.

A method is proposed, in accordance with the invention, for controlling the magnet coils of an electromagnetic actuator of an actuator device in accordance with the previous claims, whereby in a first step, for the determination of the position of the shift element and/or for a movement of the shift element into a stabile center position, a current path is opened or rather established, via each of one switch of the first and a switch of the third bridge branch, as well as through both magnet coils, while the additional switches of the shift bridge are open, whereby the current path runs from a common input to a common output of the parallel bridge branches.

A method is also proposed in which, in the first step at least one switch in the established current path is operated in a clocked mode, specifically the downstream switch.

In accordance with an aspect of the inventive method and in an alternative or additional step for the movement of the shift element into a stable end position, a current path is opened or rather established via a switch which is positioned in one bridge half of the second bridge branch and via one switch each of the first and the third bridge branch of the other bridge half, while the other switches of the shift bridge are open, whereby the current path runs from a common input to a common output of the parallel bridge branches.

Also, an inventive method is proposed in which the switches, which establish the current path, are operated in an alternative or additional step in an alternating clocked mode in the first and third bridge branch.

In accordance with an aspect of the invented method the switches, which establish the current path for the movement of the shift element into a first, stable end position and in reference to the switches which establish the current path for the movement of the shift element into a second, stable end position in the same bridge branch, are each operated in the bridge half in a closed position or in a clocked mode, respectively.

The inventive actuator device or rather the method for the control of the magnet coils of the actuator device is especially suitable for use in a motor vehicle, for instance in a passenger vehicle, or a commercial vehicle, specifically in a motor vehicle transmission, for instance in an automatic transmission, an automated shift transmission, or in a transfer transmission.

Thus, the actuator device or rather the method can be utilized for the control of the magnet coils of the actuated device for the actuation of a selector device of an automatic shift transmission of a motor vehicle, for instance instead of a pneumatically or hydraulically actuated device, wherein construction and weight can be saved. Through such a selector device, the required shift elements which are needed for a specific gear step in the shift transmission, for instance claw clutches, can be selected (selection of a shift path).

Other characteristics and advantages of the invention result from the following description of the embodiment examples of the invention, from the schematics and drawings which show important invented details. The certain characteristics can be realized as each in itself or as several together in any combination in a variation of the invention.

BRIEF DESCRIPTION OF THE EMBODIMENTS

Figure 4A:
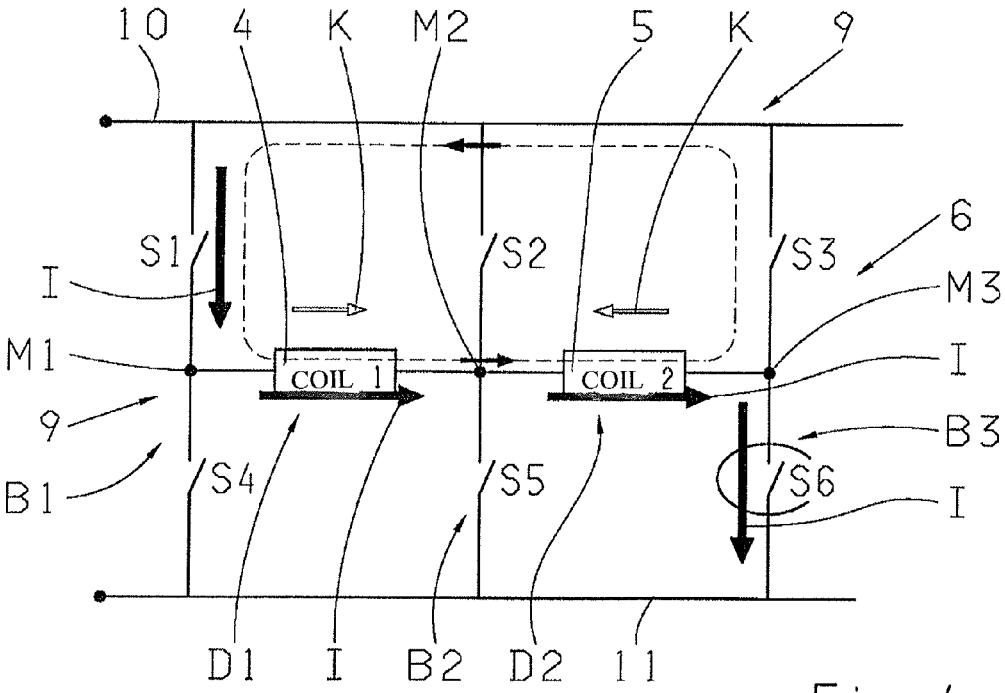
Figure 4B:
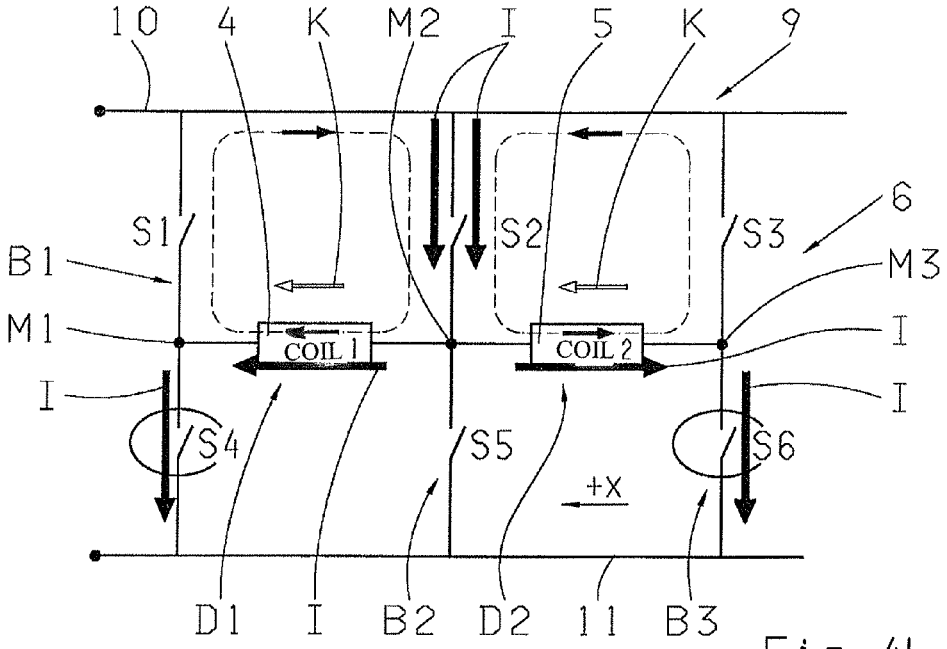
Figure 4C:
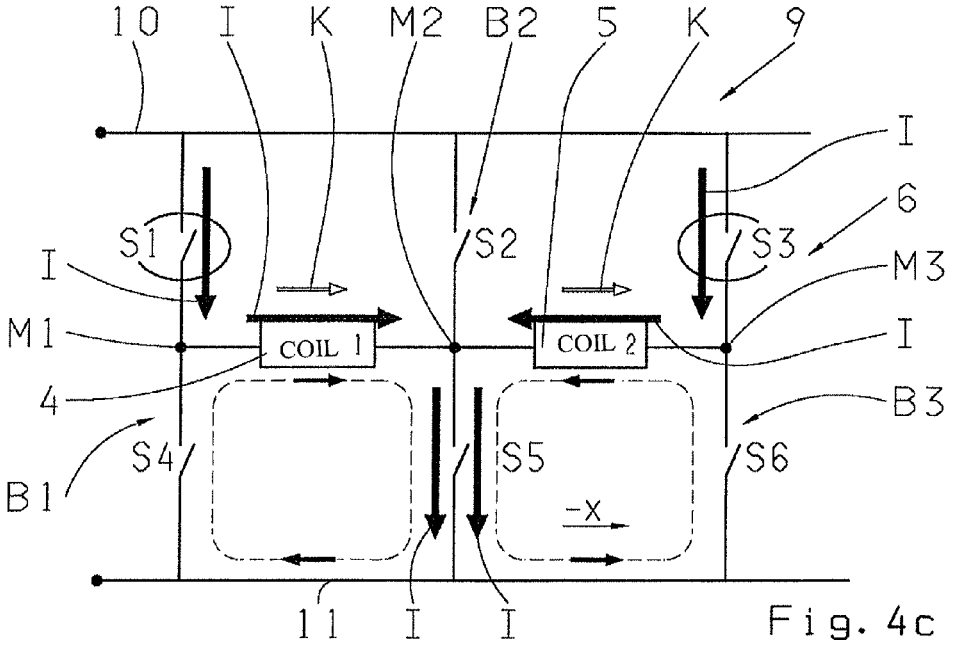

Preferred embodiments of the invention are further explained based on the provided drawings. It shows:

FIG. 1 an exemplary control circuit based on the state of the art to control a triple-position electromagnetic actuator;

FIGS. 2*a* and 2*b* an exemplary configuration of a triple-position electromagnetic actuator in accordance with the state of the art into different shift positions;

FIG. 3 in accordance with the invention, an exemplary shifting bridge of an actuator device which is configured with magnet coils of the actuator, in accordance with a possible embodiment of the invention; and FIGS. 4*a* to 4*c* exemplary the possible shift conditions of the shifting bridge which is configured with the magnet coils of the inventive actuator device to execute the inventive method.

DETAILED DESCRIPTION OF THE EMBODIMENTS

In the following description of the drawings, same elements or functions, respectively, are provided with the same reference characters.

As an example, FIG. 1 shows a circuit 1 in accordance with the state of the art to control a triple-position actuator 2 (i.e. FIG. 2*a*) and *b*)) of the previously mentioned art, from which, by means of the first H-bridge, comprising the switches S1, S2, S5, S6, and a second H-bridge configuration, comprising the switches S3, S4, S7, S8, as well as a switch S9, enables the determination of the position of an shift element 3 of the actuated 2 through a serial circuit of the magnet coils 4, 5 in the bridge diagonals when S9 is closed with an overlay of a voltage spike in accordance with the principle taught in the publication DE 10 2005 018 012 A1.

Such a triple-position actuator 2, the construction of which is generally described as an example in the a publication WO 2009/109444 and which can be used to enable the inventive actuator device 6, has generally two magnet coils 4, 5, specifically ring coils, as well as a shift element 3 which can be linearly positioned between three stable positions by means of the two magnet coils 4, 5. Such a construction is schematically presented in FIG. 2*a*) and *b*).

With appropriate control or rather energizing of the magnet coils 4, 5, the shift element 3 can be moved magnetically between two stable end positions and a stable center position. The magnetic flow B is presented as an example in FIG. 2*a*) and *b*) depending on the switch position or the direction of the current X, respectively, •of the magnet coils 4, 5 with ring-shaped lines with arrows.

The shift element 3 has, for example, a permanent magnet 7, e.g. FIG. 2*a*) and *b*), which is attached to a shift rod 8 or rather anchor rod of the shift element 3 in the linear direction X of the shift rod 8 or rather the shift element 3, between both magnet coils 4, 5 for a linear movement, wherein the permanent magnet 7 has a polarity N, S, in particular in the movement direction of the shift rod 8, and wherein the magnet coils 4, 5 are, in particular, aligned coaxially with the linear moving shift rod 8 or rather the shift element 3. The magnet coils 4, 5 have in particular opposite running windings. Preferably, the actuator 2 is designed in such a way that the shift element 3 can be magnetically stopped by the permanent magnet 7 in a stable center position.

The inventive actuator device 6 has for the control of the magnet coils 4, 5, or rather for supplying current, a shifting bridge 9 with three bridge branches B1, B2, B3 connected in parallel, where each of the exactly three bridge branches B1, B2, B3 has two switches S1 . . . S6, e.g. FIGS. 3 and 4*a*) positioned in series, in particular exactly two switches. Thus, the inventive shifting bridge 9 has a B6-topology or is designed as a B6-shifting bridge, respectively. The parallel connected bridge branches B1, B2, B3 have, in reference to the provided current flow direction, a common electrical input 10 and a common electrical output 11 at which a supply voltage can be attached to for the current injection of the magnet coils 4, 5, for instance through an energy supply device.

The first bridge branch B1, in accordance with FIGS. 3 and 4), has for instance the switches S1 and S4, the second bridge branch has the switches S2 and S5, and the third bridge branch has the switches S3 and S6. The switches S1 . . . S6 are each in either an open or closed position, and in particular are controlled for instance using a control device, to switch back and forth and particularly using a transistor switch, for instance FET's which have a controllable input and each, by means of an input control, have an open or closed function or a controllable input-output path. The input-output path of each two switches S1 . . . S6 of a bridge branch B1, B2, B3 are here connected in series within each bridge branch B1, B2, B3.

In particular, each of exactly two bridge diagonals D1, D2 of the shifting bridge 9 has, in accordance with the invention, a magnet coil 4, 5 of the actuator 2, e.g., FIGS. 3 and 4*a*) to *c*). By means of each magnet coil 4, 5, there are, therefore in each of the two bridge diagonals D1, D2, defined center taps M1, M2, M3 that are especially immediately connected together, i.e. the center tap M1 of the first bridge branch B1 connects with the center tap M2 of the second bridge branch B2, like in the first bridge diagonal D1, and the center tap M2 of the second bridge branch B2 connects with the center tap M3 of the third bridge branch B3, like the second bridge diagonal D2. Each one of the magnet coil 4, 5 is hereby connected in series between each of two center taps M1, M2 or M2, M3, respectively, e.g., FIGS. 3, 4*a*) to 4*c*).

By means of the inventive shifting bridge 9 and a connection with each of a magnet coil 4, 5 into each of one bridge diagonals D1, D2, the material needed as well as the control effort can be reduced in comparison to the state of the art, for instance FIG. 1, because the number of the needed switches S or rather needed parts, can be significantly reduced. A determination of the position of the shift element 3, by means of the principal which is mentioned in DE 10 2005 018 012 A1, but also the linear movement of the shift element 3 between three stable positions is advantageously and in a simple manner possible when the inventive shifting bridge 9 is utilized with the connection of one of each magnet coils 4, 5 in one of each bridge diagonal D1, D2. The inventive actuator device 6, also advantageously enables a quick disconnect of the current by simultaneously opening all of the switches S1 . . . S6, i.e. a quick disconnect from the supply circuit voltage, for instance on board supply voltage.

It is also provided in the invention that at least the switches S1 and S4 of the first bridge branch B1, which is electrically connected via the magnet coil 4 in the first of the two bridge diagonals D1 with the second B2 bridge branch, and the switches S3, S6 of the third bridge branch B3 which is also connected, via the magnet coil 5 in the second bridge diagonal D2, with the second bridge branch B2, are each connected to a freewheeling diode (not shown here). This creates a lower load for the supply circuit during the control or rather current supply into the switches S1 . . . S6, as it is explained or can be seen further down in the specification. The freewheeling diodes or reverse diodes, respectively, bridge in their conducting direction each of the input and the output of a connected switch S1 . . . S6, opposite to the intended direction of the current of the input-output paths S1 . . . S6, while they do not conduct in the intended current supply direction.

In accordance with the invention, the actuator device 6 is designed in a preferred embodiment to determine the position of the shift element 3 of the electromagnetic triple-position actuator 2, in particular as the previously described principle of DE 2005 018 012 A1. Hereby, the actuator device 6 has a control device (not shown) which is designed for the control of the shifting bridge 9 or its switches S1 . . . S6 in such a way that both magnet coils 4, 5 in series between the common electric input 10 and the common electrical output 11 of the bridge branches B1, B2, B3 can be activated and, by means of a supply voltage which is present at the common electric input 10 and the output 11 of the bridge branches B1, B2, B3, can be overlaid with a voltage spike. Such a control device is for instance designed based on a computerized or microprocessor supported electronic and is, for instance, also used to control the switches S1 . . . S6 for the movement of the shift element 3 in accordance with the method which is described further down.

The actuator device 6, used for determining the position of the shift element 3, has in particular a detection device (not shown) which is provided for detecting the voltage patterns at both magnet coils 4, 5 or rather during the process of the overlay with the voltage spike. The detection device is, for the purpose of measurement, connected with an electric input and an electric output of each magnet coil 4, 5.

The actuator device 6 also has, in accordance with the invention, an evaluation device for determining the position of the shift element 3 which determines the position of the shift element based on the collected voltage patterns during the voltage spikes at the control device 3. For the determination, the evaluation device generates, in particular, the difference between the voltage patterns at both of the magnet coils 4, 5 so as to determine using, the resulting voltage pattern, the position of the shift element, for example by comparison with a parameter diagram. A diagram is for example deposited in the storage unit of the evaluation device.

The detection device, the control device, and the evaluation device work together to determine the position of the shift element 3, for example particularly by means of a higher-level coordinating control unit which can also be part of the inventive actuator device 6. The detection device and/or the control device and/or the evaluation device can be designed as either separate units or as one single electronic unit.

Based on FIG. 4*a*) to *c*), examples of the current flow and the forces of the inventive actuator device 6 are shown which depend on the switch condition each of the switches S1 . . . S6 when the supply voltage is attached between the common input 10 and the common output 11, in the inventive method for controlling the magnet coils 4, 5 of an actuator 2 of an inventive actuator device 6, each of the two bridge diagonals D1, D2 of the shifting bridge 9 has a magnet coil 4, 5 of the actuator 2 connected therein, through which the shift element 3 of the actuator 2 can be shifted.

The inventive method is illustrated in FIG. 4*a* with the step for shifting a shift element 3 into the stable center position and/or for determining the position of the shift element, i.e. for the overlay of both magnet coils 4, 5 with a voltage spike. Herein, the switch S1 is permanently closed and the switch S6, i.e. the current downstream switch, is at least temporarily closed, wherein the switch S6, in accordance with the invention, is preferably operated in a clocked mode, i.e. opens and closes, to adjust the current through the magnet coil 4, 5 which in this circuit are attached in series to the supply network. A clocked operating mode takes place in particular using a pulse width modulated control signal, which is for example present at one control input of the switch S6, generated by a control device.

Thus, this step creates a current path, in accordance with the invention, via each switch of the first B1 and each switch of the third B3 bridge branch, as well as both magnet coils 4, 5, while the additional switches of the shifting bridge 9 are open or rather block a current flow. The flow of current runs from the common input to the common output of the parallel bridge branches B1, B2, B3.

The flow of current in a possible embodiment runs in accordance with FIG. 4*a*) via the switch S1 and S6, as well as the magnet coils 4, 5, from the common input and to the common output 11 of the parallel bridge branches B1, B2, B3, as illustrated by arrows I in FIG. 4*a*.

Free-wheeling is provided herein by means of a reverse diode of the switch S3 (dotted line). Dependent on the winding of the coils 4, 5, a power reaction is created at the shift element 3 into the center position, illustrated with arrows K. Both magnet coils 4, 5 repel the permanent magnet 7 of the shift element 3. Symmetrical voltage flows are created at the coils 4, 5 during the overlay with a voltage spike. The magnetic flow within this configuration corresponds for instance with the one presented in FIG. 2*b*.

An additional, alternative or further method step of the inventive method, which is shown as an example in FIG. 4*b*, with its first shifting direction +X for the shift element 3, and with an opposite shifting direction −X as shown FIG. 4*c*, the shifting of the shift element 3 into the respective stable end positions by establishing a current flow via exactly one switch S2 or rather S5 of the second bridge branch B2, which is positioned in a first bridge half, and each of a switch S4 or S1/S3, or S6, respectively, of the first B1 and third B3 bridge branch of the other or rather a second bridge half while the other switches S1, S3, S5 or S2, S4, S6 are open or rather disconnected. One bridge half comprises the switches S1, S2, S3 or the switches at the input side of each bridge branch B1, B2, B3, the other of the switches S4, S5, S6 or rather the switches at the output side of each of the bridge branches B1, B2, B3. The flow of current shown by the arrows I runs from a common input 10 to a common output 11 of the parallel bridge branches B1, B2, B3.

In the exemplary step shown in FIG. 4*b*, the switch S2 is in particular permanently closed for shifting the shift element 3 into the direction of the arrows K or shifting direction +X, the switches S4 and S6 are also closed, at least temporarily. To keep the load of the supply network or onboard network at a minimum, the switches S4 and S6, i.e. of the first B1 and third B3 bridge branch are, in accordance with the invention, clocked in an alternating mode. Through the freewheeling diodes of the switches S1 and S3, freewheeling is provided which the supply network during the alternating clocking of the switches S4 and S6 does preferably not recognize (dotted line). In comparison to FIG. 4*a* which shows shifting in the center position, the current path in the first coil 4 reverses, and therefore reverses also the direction of the force of the first coil 4 which impacts the shift element 3 shown in FIG. 2*a*.

FIG. 4*c* exemplifies the execution of the alternative or additional method step during the shifting of shift element 3 in the opposite direction −X to assume the second, stable end position. In accordance with FIG. 4*c*, the switches which create the current path, illustrated with the arrows I, for shifting of the shift element 3 in reference to the switches which create the current path of the shift element 3 into the first, stable end position in accordance with FIG. 4*b*, in the same bridge branch B1, B2, B3, but in each of the other bridge half, are closed or rather are clocked operated, i.e. inverted in reference to the bridge diagonal D1, D2.

In the additional, alternative method step as presented in FIG. 4*c* for shifting the shift element 3 in the direction of the force K, the switch S5 is permanently closed for shifting the shift element 3, the switches S1 and S3 are also closed, at least temporarily. To keep the supply network or rather the onboard network low, the switches S1 and S3 are, in accordance with the invention, preferably clocked in an alternating mode. Through the freewheeling diodes of the switches S4 and S6, freewheeling is provided (dotted line), which the supply network through the alternating clocking of the switches S1 and S3 preferably does not recognize. In comparison to FIG. 4*b*, the flow direction of the current in both coils 4, 5 reverses and thus, the direction of the forces K of both magnet coils 4, 5 which impact the shift element 3.

It is provided, in accordance with the invention, to stop the supply of current into the magnet coils 4, 5, as soon as the intended, stable end or center position of the shift element 3 has been achieved. Such switch positions, in which all switches S1 . . . S6 of the shifting bridge 9 are open, is shown in FIG. 3. In each of the end or center positions, the permanent magnet 7 of the shift element 3 can hold the position, i.e. due to the magnetism.

It needs to be mentioned that the invention can be enabled by the person skilled in the art, also with an inverted current direction and the respective change of the winding direction. In this case, the common input 10 and the common output 11 are reversed. This embodiment and additional possible embodiments, easily recognizable by the person skilled in the art, are also claimed by this invention if it is included in the inventive thoughts.

Reference Characters

1 Circuit (State of the Art)
2 Actuator
3 Shift Element
4, 5 Magnet Coil
6 Actuator Device
7 Permanent Magnet
8 Shift Rod
9 Shifting Bridge
10 Common Input
11 Common Output
I Current Path
K Force
N, S Poles of Magnet
X Shift Direction
B1 . . . B3 Bridge Branch
D1, D2 Bridge Diagonal
M1 . . . M3 Center Tab
S1 . . . S6 Switch

The invention claimed is:

1. An actuator device (6) with an electromagnetic actuator (2) which has first and second magnet coils (4, 5), as well as a shift element (3) which is linearly shifted by the first and the second magnet coils between three stable positions, the actuator device (6) further comprising a shifting bridge (9), with three parallel connected bridge branches (B1, B2, B3), for controlling the magnet coils (4, 5), each of the three parallel connected bridge branches (B1, B2, B3) having first and second switches (SI . . . S6) connected in series, and the first magnet coil (4) being connected in a first bridge diagonal (D1) while the second magnet coil (5) being connected in a second bridge diagonal (D2).

2. The actuator device (6) as in claim 1, wherein the shifting bridge (9) is a B6-shifting bridge.

3. The actuator device (6) according to claim 1, wherein at least the switches (S1, S4) of a first (B1) of the three bridge branches (B1, B2, B3), which is electrically connected via the first magnet coil (4) in the first bridge diagonal (D1, D2), with a second (B2) of the three bridge branches (B1, B2, B3), and the switches (S3, S6) of a third (B3) of the three bridge branches (B1, B2, B3) which are, via a magnet coil (5) in a second (D2) of the bridge diagonals (D1, D2), also connected with the second bridge branch (B2), have each a freewheeling diode connected thereto.

4. The actuator device (6) according to claim 1, wherein the actuated device (6) is designed for a determination of a position of the shift element (3).

5. The actuator device (6) according to claim 4, wherein the actuated device (6) has, for the determination of the position of the shift element (3), a control device which is designed for the control of the shifting bridge (9) in a way that the first and the second the magnet coils (4, 5) are activated in series between a common electric input (10) and a common electric output (11) of the bridge branches (B1, B2, B3), to which a supply voltage with a voltage spike is attachable thereto.

6. The actuator device (6) according to claim 5, further comprising that the actuator device (6) has a detection device, for the determination of the position of the shift element (3), base upon a determination of voltage patterns at least one of the first and the second magnet coils (4, 5) during an overlay with the voltage spike.

7. The actuator device (6) according to claim 4, further comprising that the actuator device (6) has an evaluation device, for calculation of the position of the shift element (3), which determines the position of the shift element (3) based on determined voltage patterns during the voltage spike by a comparison of at least one voltage pattern with a characteristics diagram.

8. A method for control of first and second magnet coils (4, 5) of an electromagnetic actuator (2) of an actuator device (6) and a shift element (3) which is linearly shifted by the first and the second magnet coils between three stable positions, the actuator device (6) further comprising a shifting bridge (9) with three parallel connected bridge branches (B1, B2, B3) for controlling the first and the second magnet coils (4, 5), each bridge branch of the three parallel connected bridge branches (B1, B2, B3) has first and second switches (S1 . . . S6) connected in series, and the first magnet coil (4) being connected in a first bridge diagonal (D1) while the second magnet coil (5) being connected in a second bridge diagonal (D2), the method comprising the steps of:

establishing a current path through each of a switch (S1; S4) of a first (B1) bridge branch and a switch (S3; S6) of a third (B3) bridge branch, and through both of the first and the second magnet coils (4, 5), while the additional switches (S2, S3, S4, S5; S1, S2, S5, S6) are open, running the current path from a common input (10) to a common output (11) of the parallel bridge branches (B1, B2, B3) for at least one of determination of the position of the shift element (3) and for shifting of the shift element (3) to a stable center position.

9. The method according to claim 8, further comprising the step of operating at least one switch (S6) in the established current path in a clocked mode.

10. The method according to claim 8, further comprising the step of shifting the shift element (3) into a stable end position by establishing a current path, via one switch (S2; S5), positioned in a bridge half of the second bridge branch (B2) and each of a switch (S4, S6; S1, S2) of the first (B1) and the third (B3) bridge branch in each of the other bridge half, and opening the additional switches (S1, S3, S5; S2, S4, S6) such that the current path runs from the common input (10) to the common output (11) of the parallel bridge branches (B1, B2, B3).

11. The method according to claim 10, further comprising the step of operating the switches (S2, S4, S6; S1, S3, S5), which enable the current path, in a clocked mode during either an alternative or additional step on an alternating basis in the first (B1) and the third (B3) bridge branch.

12. The method according to claim 10, further comprising the step of operating the current path which is established through the switches (S2, S4, S6) for the shifting of the shift element (3) into a first solid end position in reference to the switches (S1, S3, S5) which establish the current path for the shifting of the shift element (3) into a second, solid end position, in either a closed or a clock mode in the same bridge branch (B1, B2, B3) in each of the other bridge half.

13. The actuator device (6) according to claims 1, wherein the actuator device is incorporated into a transmission of a motor vehicle.

14. The method according to claim 8, further comprising the step of actuating a selection device of an automated shift transmission with the actuator device (6).

* * * * *